US011085368B2

(12) United States Patent
Andersson et al.

(10) Patent No.: US 11,085,368 B2
(45) Date of Patent: Aug. 10, 2021

(54) INTERNAL COMBUSTION ENGINE ARRANGEMENT

(71) Applicant: VOLVO TRUCK CORPORATION, Gothenburg (SE)

(72) Inventors: Arne Andersson, Mölnlycke (SE); Staffan Lundgren, Hindås (SE)

(73) Assignee: VOLVO TRUCK CORPORATION, Gothenburg (SE)

( * ) Notice: Subject to any disclaimer, the term of this patent is extended or adjusted under 35 U.S.C. 154(b) by 0 days.

(21) Appl. No.: 16/638,575

(22) PCT Filed: Sep. 4, 2017

(86) PCT No.: PCT/EP2017/072129
§ 371 (c)(1),
(2) Date: Feb. 12, 2020

(87) PCT Pub. No.: WO2019/042575
PCT Pub. Date: Mar. 7, 2019

(65) Prior Publication Data

US 2020/0217244 A1 Jul. 9, 2020

(51) Int. Cl.
*F02B 41/06* (2006.01)
*F02B 33/22* (2006.01)
(Continued)

(52) U.S. Cl.
CPC ..... *F02B 41/06* (2013.01); *F02B 33/22* (2013.01); *F01L 2003/258* (2013.01); *F02B 3/06* (2013.01);
(Continued)

(58) Field of Classification Search
CPC .. F02B 41/06; F02B 33/22; F02B 3/06; F02B 75/02; F02B 2075/027; F02B 41/08
See application file for complete search history.

(56) References Cited

U.S. PATENT DOCUMENTS 967,828 A 8/1910 Pierson
3,958,900 A * 5/1976 Ueno ..... F01L 13/06 417/237
(Continued)

FOREIGN PATENT DOCUMENTS

CN 101307718 A 11/2008
CN 106089409 A 11/2016
(Continued)

OTHER PUBLICATIONS

International Search Report and Written Opinion in corresponding International Application No. PCT/EP2017/072129 dated Nov. 9, 2017 (12 pages).
(Continued)

*Primary Examiner* — Hung Q Nguyen
(74) *Attorney, Agent, or Firm* — Venable LLP; Jeffri A. Kaminski

(57) ABSTRACT

The present invention relates to an internal combustion engine arrangement for a vehicle, said internal combustion engine arrangement comprising a combustion cylinder housing a reciprocating combustion piston, and an expansion cylinder housing a reciprocating expansion piston, said expansion cylinder being arranged in downstream fluid communication with the combustion cylinder for receiving combustion gases exhausted from the combustion cylinder, wherein the internal combustion engine arrangement further comprises a pressure tank arranged in fluid communication with the expansion cylinder, wherein the internal combustion engine arrangement is further arranged to be operated in a first operating mode in which compressed gas generated in the expansion cylinder is delivered to the pressure tank, and a second operating mode in which compressed gas contained in the pressure tank is delivered from the pressure tank to the expansion cylinder.

16 Claims, 6 Drawing Sheets

(51) Int. Cl.
*F01L 3/00* (2006.01)
*F02B 3/06* (2006.01)
*F02B 75/02* (2006.01)

(52) U.S. Cl.
CPC ..... *F02B 75/02* (2013.01); *F02B 2075/027* (2013.01)

(56) References Cited

U.S. PATENT DOCUMENTS 4,040,400 A 8/1977 Kiener
4,211,083 A * 7/1980 Ueno ..... F01L 13/06 60/626
4,512,154 A * 4/1985 Ueno ..... F02N 9/04 60/626
4,565,167 A * 1/1986 Bryant ..... F02B 33/22 123/560
4,783,966 A 11/1988 Aldrich
4,917,054 A * 4/1990 Schmitz ..... F02B 75/021 123/58.8
5,638,681 A * 6/1997 Rapp ..... F01B 17/02 123/68
8,412,441 B1 4/2013 Sturman
8,800,510 B2 8/2014 Carlson et al.
2003/0049139 A1* 3/2003 Coney ..... F02B 37/04 417/243
2007/0157894 A1* 7/2007 Scuderi ..... F02D 17/026 123/70 R
2010/0000806 A1 1/2010 Caudill
2012/0090580 A1* 4/2012 Hu ..... F02D 13/028 123/564
2012/0255296 A1* 10/2012 Phillips ..... F02B 21/02 60/526
2012/0260627 A1 10/2012 Durrett et al.
2014/0261325 A1* 9/2014 Scuderi ..... F02B 41/06 123/445
2016/0333778 A1 11/2016 Andersson et al.

FOREIGN PATENT DOCUMENTS

GB 2428653 A 2/2007
WO 9906682 A2 2/1999
WO 2015090340 A1 6/2015
WO 2017101965 A1 6/2017
WO 2017101967 A1 6/2017

OTHER PUBLICATIONS

China Office Action dated Apr. 14, 2021 in corresponding China Patent Application No. 201780094335.6, 18 pages.

* cited by examiner

INTERNAL COMBUSTION ENGINE ARRANGEMENT

CROSS-REFERENCE TO RELATED APPLICATIONS

This application is a U.S. National Stage application of PCT/EP2017/072129, filed Sep. 4, 2017 and published on Mar. 7, 2019 as WO/2019/042575, all of which is hereby incorporated by reference in its entirety.

TECHNICAL FIELD

The present invention relates to an internal combustion engine arrangement. The invention also relates to a corresponding method for controlling an internal combustion engine. The invention is applicable on vehicles, in particularly low, medium and heavy duty vehicles commonly referred to as trucks. Although the invention will mainly be described in relation to a truck, it may also be applicable for other type of vehicles such as e.g. working machines, buses, etc.

BACKGROUND

For many years, the demands on internal combustion engines have been steadily increasing and engines are continuously developed to meet the various demands from the market. Reduction of exhaust gases, increasing engine efficiency, i.e. reduced fuel consumption, and lower noise level from the engines are some of the criteria that becomes an important aspect when choosing vehicle engine. Furthermore, in the field of trucks, there are applicable law directives that have e.g. determined the maximum amount of exhaust gas pollution allowable. Still further, a reduction of the overall cost of the vehicle is important and since the engine constitutes a relatively large portion of the total costs, it is natural that also the costs of engine components are reduced.

In order to meet the described demands, various engine concepts are continuously developed. In some concepts, conventional power cylinders are combined with e.g. a pre-compression stage and/or an expansion stage. In other concepts, a combustion engine propelled by e.g. petrol or diesel is combined with an additional engine propelled by another type of propellant. Such additional engine may, for example, be an electric motor. Also, engines propelled by alternative fuels such as DME and natural gas are increasingly popular as their pollution is less harmful to the ambient environment.

Although the development of engine concepts have provided engines exhausting lower amount of environmentally harmful pollutions, there is still a continuous demand of developing the engines to be able to, for example, further improve the utilization of power of the vehicles.

SUMMARY

It is an object of the present invention to provide an internal combustion engine arrangement which at least partially overcomes the above described deficiencies. This is achieved by a method according to claim 1.

According to a first aspect of the present invention, there is provided an internal combustion engine arrangement for a vehicle, the internal combustion engine arrangement comprising a combustion cylinder housing a reciprocating combustion piston, and an expansion cylinder housing a reciprocating expansion piston, the expansion cylinder being arranged in downstream fluid communication with the combustion cylinder for receiving combustion gases exhausted from the combustion cylinder, wherein the internal combustion engine arrangement further comprises a pressure tank arranged in fluid communication with the expansion cylinder, wherein the internal combustion engine arrangement is further arranged to be operated in a first operating mode in which compressed gas generated in the expansion cylinder is delivered to the pressure tank, and a second operating mode in which compressed gas contained in the pressure tank is delivered from the pressure tank to the expansion cylinder.

The pressure tank should be understood as a tank which is able to contain compressed gas having a relatively high gas pressure. The pressure tank may thus also be referred to as a high pressure tank or a pressure vessel. As described above, the pressure tank is arranged in fluid communication with the expansion cylinder. Hereby, compressed gas generated in the expansion cylinder can be delivered to the pressure tank, in which the compressed gas is contained during a desired time frame.

The wording "operating modes" should be construed as different ways of operating the internal combustion engine arrangement. The first operating mode may preferably relate to an engine brake state operation of the vehicle. Hereby, during engine braking, high pressure gas is delivered to the pressure tank. Thus, during an engine braking operating state the internal combustion engine arrangement can be operated in the first operating mode. The second operating mode may on the other hand relate to an air hybrid state where the compressed gas contained in the pressure tank is delivered to the expansion cylinder for propulsion thereof. Thus, when there is a desire to operate the vehicle in the air hybrid state, the internal combustion engine arrangement can be operated in the second operating mode. The first and second operating modes are preferably used in conjunction with a normal operating mode in which compressed combustion gas is directed from the combustion cylinder to the expansion cylinder, thus providing three operating modes. Also, the internal combustion engine may be operated in a mixed mode. In such mixed mode, the internal combustion engine can be operated in the normal operating mode and whereby an increased power is achieved by simultaneously adding compressed gas from the pressure tank to the expansion cylinder.

Furthermore, the combustion cylinder may preferably be arranged to operate in a four stroke fashion, while the expansion cylinder may preferably be arranged to operate in a two stroke fashion.

The present invention is based on the insight that by combining the combustion cylinder with the expansion cylinder, the expansion cylinder can be arranged to operate as a pump to deliver compressed gas generated in the expansion cylinder to the pressure tank. It has been realized that the pressure levels generated in the expansion cylinder may be well suited for delivery to a pressure tank for subsequent use thereof. The expansion cylinder may thus, and as is described further below, receive ambient air which is compressed by the relatively large expansion ratio of the expansion cylinder and delivered to the pressure tank. The compressed gas contained in the pressure tank may thus, at a subsequent point in time be exhausted from the pressure tank and delivered to the expansion cylinder. In the latter case, the expansion cylinder is operated by means of the compressed gas delivered from the pressure tank. An advantage of the invention is thus that the engine may be operated as an internal combustion engine when the operating conditions for doing so are beneficial, and operated as an air hybrid vehicle when the operating conditions for doing so are beneficial. The fuel consumption of the vehicle will hereby be reduced. Furthermore, the internal combustion engine arrangement is well suited for being combined with e.g. electric motor propulsion. In such case, the vehicle may be propelled by the electric motor at operating conditions where low power consumption is required, and operated as an air hybrid vehicle when an increasing power demand is required. Hereby, an electric motor with reduced power capability can be used, thus reducing the overall cost and weight of the vehicle. The vehicle may be operated as an air hybrid in conjunction with the operation of the electric motor.

According to an example embodiment, the expansion cylinder may be arranged to compress ambient air and to pump compressed ambient air to the pressure tank when the internal combustion engine arrangement is operated in the first operating mode.

As described above, the expansion cylinder is filling the function of an air/gas pump. Thus, no additional air/gas pump is required for forcing the compressed gas to the pressure tank. As will be described below, the expansion cylinder may be arranged with suitable properties for acting as an air/gas pump. For example, the expansion cylinder will be well heat insulated and provided with a large expander volume. Hereby, the expansion cylinder is substantially adiabatic. The air may be provided through outlet valve(s) of the expansion cylinder before being compressed by the expansion cylinder and further delivered to the pressure tank. Before such case, the internal combustion engine may, for a predetermined time period, inhibit combustion by the combustion cylinder such that no (or a small amount of) exhaust gases are present in the air delivered into the expansion cylinder via the outlet valve(s).

According to an example embodiment, combustion gas from the combustion cylinder may be prevented from being directed to the expansion cylinder when the internal combustion engine arrangement is operated in the second operating mode.

According to an example embodiment, the internal combustion engine arrangement may further comprise a control unit for selectively controlling the internal combustion engine to be operated in either one of the first and second operating modes. The control unit may also control the internal combustion engine to be operated in the above described normal operating mode. Selectively should thus not be construed as operating the internal combustion only between the first and second operating mode, but between other operating modes as well.

According to an example embodiment, the control unit may be configured to receive a signal indicative of a braking operation for the vehicle; and control the internal combustion engine arrangement to be operated in the first operating mode when the vehicle is exposed to the braking operation.

As described above, the braking operation preferably relates to engine braking of the vehicle. Operating the internal combustion engine arrangement in the first operating mode during braking is preferable as the combustion cylinder is not exposed to a combustion operation. Hereby, surplus energy can be used for compressing the gas in the expansion cylinder and subsequently for delivery to the pressure tank. An advantage is thus that improved utilization of energy is provided.

The control unit may include a microprocessor, microcontroller, programmable digital signal processor or another programmable device. The control unit may also, or instead, include an application specific integrated circuit, a programmable gate array or programmable array logic, a programmable logic device, or a digital signal processor. Where the control unit includes a programmable device such as the microprocessor, microcontroller or programmable digital signal processor mentioned above, the processor may further include computer executable code that controls operation of the programmable device.

According to an example embodiment, the control unit may be further configured to receive a signal indicative of a power level required for the vehicle, compare the required power level with a predetermined threshold limit; and control the internal combustion engine arrangement to be operated in the second operating mode when the required power level exceeds the predetermined threshold limit.

Hereby, and as described above, the vehicle may be operated as an air hybrid at time periods when there is an increased power demand.

According to an example embodiment, the internal combustion engine arrangement may further comprise a valve arrangement positioned in fluid communication with the combustion cylinder, the expansion cylinder and the pressure tank.

The valve arrangement may preferably be designed as a three-way valve, wherein a normal operating position of the valve arrangement provides the combustion cylinder in fluid communication with the expansion cylinder and wherein a first operating position provides the pressure tank in downstream/upstream fluid communication with the expansion cylinder. In the first operating position, the combustion cylinder is preferably in no fluid communication with the pressure tank as well as the expansion cylinder. Thus, in the second position, compressed gas can be directed from the pressure tank to the expansion cylinder, or vice versa.

According to an example embodiment, the internal combustion engine arrangement may further comprise an intermediate tank positioned in fluid communication between the combustion cylinder and the expansion cylinder, the intermediate tank being arranged to contain compressed gas exhausted from the combustion cylinder. Hereby, the gas pressure level and the flow of combustion gas between the combustion cylinder and the expansion cylinder can be further controlled.

According to an example embodiment, the valve arrangement may be arranged downstream the intermediate tank.

According to an example embodiment, the internal combustion engine arrangement may further comprise a heat regenerator arranged in fluid communication between the expansion cylinder and the pressure tank, the heat regenerator being arranged to absorb heat from the compressed gas generated in the expansion cylinder.

A heat regenerator should be understood to mean an arrangement which is able to receive and absorb heat. The heat regenerator is thus arranged to absorb the heat in the relatively warm compressed gas before delivery to the pressure tank. Thus, the temperature of the gas in the pressure tank is therefore relatively low, preferably at similar temperature levels as the ambient temperature. Hereby, the thermal isolation properties of the pressure tank can be reduced. Also, using a heat regenerator will enable the compressed gas delivered from the pressure tank to the expansion cylinder to have a temperature level substantially corresponding to the temperature level of the compressed gas delivered from the expansion cylinder to the heat regenerator. Accordingly, a substantially reversible process is achieved.

According to an example embodiment, the heat regenerator may be arranged such that an inlet portion of the heat regenerator connected to the expansion cylinder has a temperature level substantially corresponding to the temperature level of the compressed gas generated in the expansion cylinder, and an outlet portion of the heat regenerator has a temperature level substantially corresponding to an ambient temperature of the internal combustion engine arrangement.

According to an example embodiment, the expansion cylinder may comprise a geometric compression ratio of at least 40, the compression ratio being a ratio between a maximum and a minimum volume formed by the reciprocating motion of the expansion piston within the expansion cylinder.

Using a relatively high compression ratio, i.e. above 40, preferably above 80, and more preferably around 100, the expansion cylinder is well suited to sufficiently compress the received air/gas and to operate as an air/gas pump. An increased efficiency of the expansion cylinder when operated as an air/gas pump is thus achieved.

According to an example embodiment, the internal combustion engine arrangement may further comprise a compression cylinder housing a reciprocating piston, the compression cylinder being arranged in upstream fluid communication with the combustion cylinder for delivery of compressed air to the combustion cylinder.

According to an example, the compression cylinder may be operated as a two stroke compression cylinder.

According to a second aspect, there is provided a method for controlling an internal combustion engine arrangement, the internal combustion engine arrangement comprising a combustion cylinder housing a reciprocating combustion piston, an expansion cylinder housing a reciprocating expansion piston, the expansion cylinder being arranged in downstream fluid communication with the combustion cylinder for receiving combustion gases exhausted from the combustion cylinder, and a pressure tank arranged in fluid communication with the expansion cylinder, wherein the method comprises the steps of determining an operating state of the vehicle, if the vehicle is operated in a first operating state: controlling compressed gas generated in the expansion cylinder to be delivered to the pressure tank; and if the vehicle is operated in a second operating state: controlling compressed gas contained in the pressure tank to be delivered to the expansion cylinder.

An advantage is thus, as described above, that the internal combustion engine can be operated in different modes which will e.g. reduce the fuel consumption. Also, the method is well suitable for combining with operation of an electric motor.

Further effects and features of the second aspect are largely analogous to those described above in relation to the first aspect. In detail, features described above in relation to the first aspect can equally well be combined with features of the second aspect.

According to a third aspect, there is provided a vehicle comprising an internal combustion arrangement according to any one of the embodiments described above in relation to the first aspect.

According to an example embodiment, the vehicle may further comprise a second prime mover different from the internal combustion engine arrangement, wherein the vehicle is configured to be operated in a first vehicle state in which the vehicle is propelled by providing compressed gas from the pressure tank to the expansion cylinder; and a second vehicle state in which the vehicle is propelled by using the second prime mover.

According to an example embodiment, the vehicle may be operated in the first vehicle state when the power requirement for the vehicle is higher in comparison to operation in the second vehicle state.

Further effects and features of the third aspect are largely analogous to those described above in relation to the first aspect. As for the second aspect, features described above in relation to the first aspect can equally well also be combined with features of the third aspect.

According to a fourth aspect, there is provided a computer program comprising program code means for performing the steps of the second aspect when the program is run on a computer.

According to a fifth aspect, there is provided a computer readable medium carrying a computer program comprising program means for performing the steps of the second aspect when the program means is run on a computer.

Effects and features of the fourth and fifth aspects are largely analogous to those described above in relation to the first aspect.

Further features of, and advantages with, the present invention will become apparent when studying the appended claims and the following description. The skilled person realize that different features of the present invention may be combined to create embodiments other than those described in the following, without departing from the scope of the present invention.

BRIEF DESCRIPTION OF THE DRAWINGS

The above, as well as additional objects, features and advantages of the present invention, will be better understood through the following illustrative and non-limiting detailed description of exemplary embodiments of the present invention, wherein.

DETAILED DESCRIPTION OF EXAMPLE EMBODIMENTS OF THE INVENTION

Figure 1:
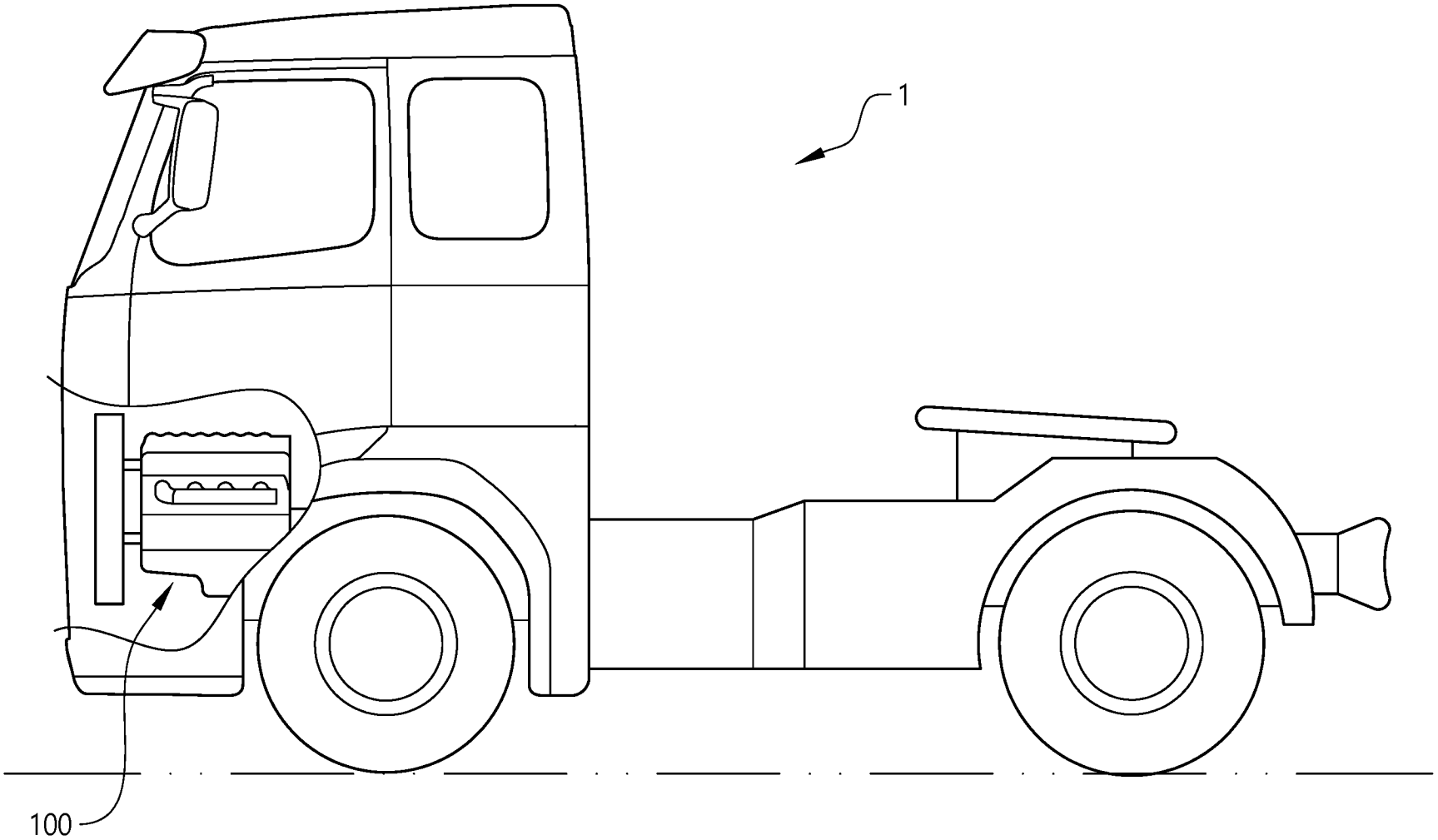
FIG. 1 is a lateral side view illustrating an example embodiment of a vehicle in the form of a truck.

The present invention will now be described more fully hereinafter with reference to the accompanying drawings, in which exemplary embodiments of the invention are shown. The invention may, however, be embodied in many different forms and should not be construed as limited to the embodiments set forth herein; rather, these embodiments are provided for thoroughness and completeness. Like reference character refer to like elements throughout the description.

With particular reference to FIG. 1, there is provided a vehicle 1 in the form of a truck. The vehicle 1 comprises an engine 100 in the form of an internal combustion engine arrangement 100 as will be described further below in relation to the description of e.g. FIGS. 2 and 3. The internal combustion engine arrangement 100 is preferably propelled by e.g. a conventional fuel such as diesel.

Figure 2:
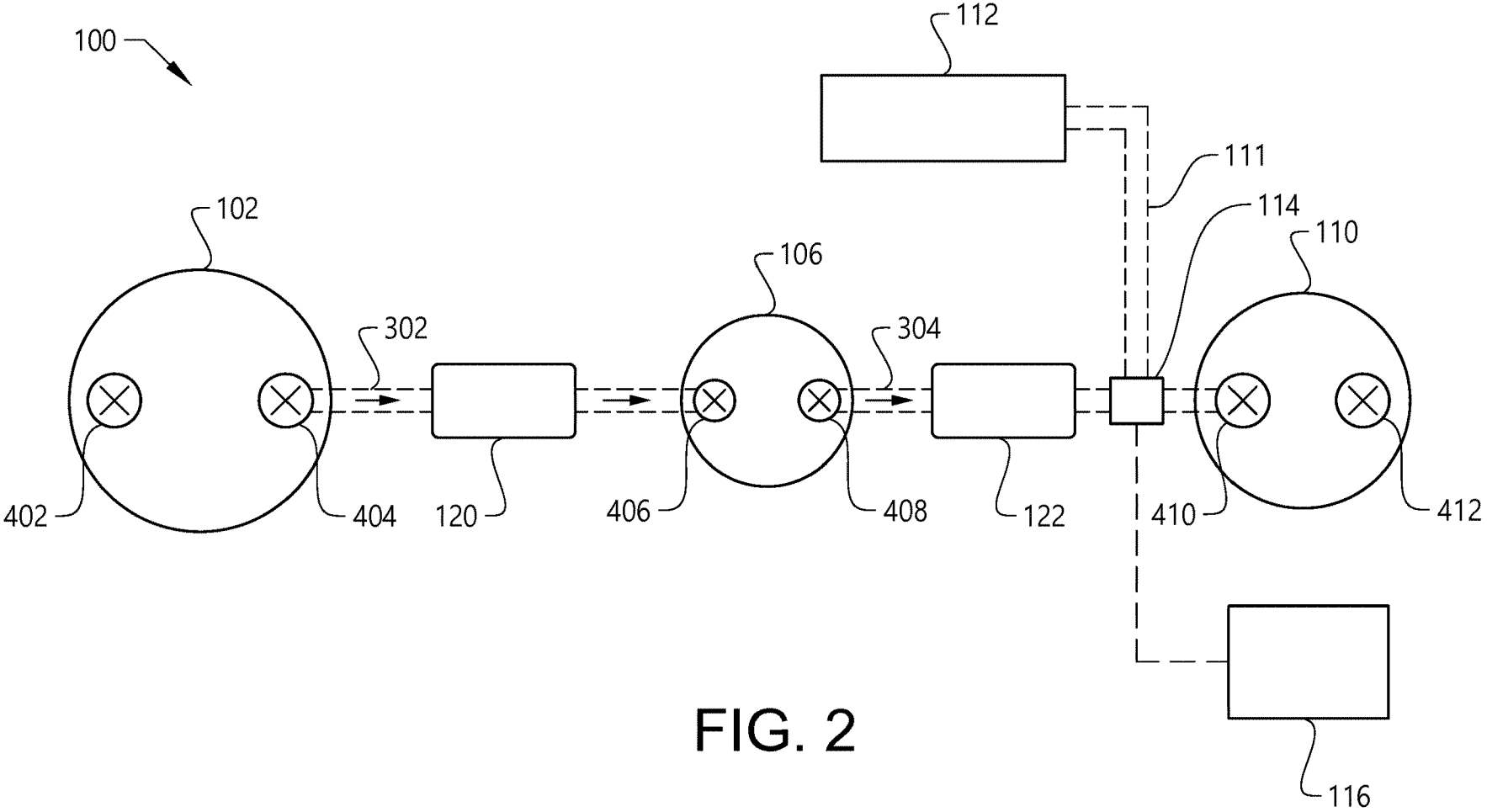
FIG. 2 is a schematic illustration of an internal combustion engine arrangement according to an example embodiment.

With reference to FIG. 2, a schematic illustration of the internal combustion engine arrangement 100 according to an example embodiment is depicted. According to the example embodiment depicted in FIG. 2, the internal combustion engine arrangement 100 comprises a compression cylinder 102. The compression cylinder 102 comprises a reciprocating compression piston (not shown), i.e. the reciprocating compression piston is housed within the compression cylinder 102 to operate in a reciprocating motion between an upper end, also commonly referred to as top dead center (TDC) and a lower end, also commonly referred to as bottom dead center (BDC). The compression cylinder 102 further comprises an inlet valve 402 at which gas, preferably in the form of air at ambient gas pressure is controllably provided into the compression cylinder 402. The compression cylinder 102 also comprises an outlet valve 404 through which compressed gas is controllably exhausted from the compression cylinder 102. The compression cylinder 102 is preferably operated in a two stroke fashion.

Furthermore, the internal combustion engine arrangement 100 comprises a combustion cylinder 106 arranged in downstream fluid communication with the compression cylinder 102, via a conduit 302. The combustion cylinder 106 comprises a reciprocating piston (not shown), i.e. the reciprocating combustion piston is housed within the combustion cylinder 106 to operate in a reciprocating motion between the TDC and the BDC of the combustion cylinder. The combustion cylinder 106 further comprises an inlet valve 406, at which compressed gas from the compression cylinder 102 is controllably provided into the combustion cylinder 106. The combustion cylinder 106 further comprises an outlet valve 408 through which compressed combustion gas is exhausted from the combustion cylinder 106. The combustion cylinder 106 is preferably operated in a four stroke fashion. Also, the combustion cylinder 106 comprises a fuel injection system (not shown) for providing fuel into the combustion cylinder 106 for combustion therein.

Moreover, the internal combustion engine arrangement 100 comprises an expansion cylinder 110 arranged in downstream fluid communication with the combustion cylinder 106 via a conduit 304. The expansion cylinder 110 comprises a reciprocating expansion piston (not shown), i.e. the reciprocating expansion piston is housed within the expansion cylinder 110 to operate in a reciprocating motion between the TDC and the BDC of the expansion cylinder. The expansion cylinder 110 further comprises an inlet valve 410, at which compressed combustion gas from the combustion cylinder 106 is controllably provided into the expansion cylinder 110. The expansion cylinder 110 further comprises an outlet valve 412 through which expanded combustion gas is exhausted from the expansion cylinder 110 to an aftertreatment system (not shown) or the like.

As further depicted in FIG. 2, the internal combustion engine arrangement 100 comprises a pressure tank 112. The pressure tank 112 is arranged in fluid communication with the expansion cylinder 112 via a pressure tank conduit 111. As will be described further below, the pressure tank 112 is arranged to controllably receive compressed gas from the expansion cylinder 110, and to controllably deliver compressed gas to the expansion cylinder 110, in dependence of a current operating mode of the internal combustion engine arrangement 100. Accordingly, the pressure tank 112 should be designed to withstand gas pressure levels corresponding to at least the gas pressure level of the compressed gas generated in the expansion cylinder 110.

Moreover, in order to control delivery of compressed gas from the expansion cylinder 110 to the pressure tank 112, or from the pressure tank 112 to the expansion cylinder 110, the internal combustion arrangement 100 comprises a valve arrangement 114. The valve arrangement 114 is preferably a three-way valve arrangement connected in fluid communication with the combustion cylinder 106, the expansion cylinder 110 and the pressure tank 112. The valve arrangement 114 is also connected to a control unit 116 for controlling the valve arrangement 114. The valve arrangement 114, and its positions controlled by the control unit 116 will be described in further detail below in relation to the description of FIGS. 3*a*-3*c*.

As is further depicted in the example embodiment of FIG. 2, the internal combustion engine arrangement 100 comprises a first 120 and a second 122 intermediate tank. The first intermediate tank 120 is positioned in the conduit 302 and thus arranged in fluid communication between the compression cylinder 102 and the combustion cylinder 106. The first intermediate tank 120 may also be referred to as an intermediate low pressure gas tank. The second intermediate tank 122 is positioned in the conduit 304 and thus arranged in fluid communication between the combustion cylinder 106 and the expansion cylinder 110, or more precisely in fluid communication between the combustion cylinder 106 and the valve arrangement 114. The second intermediate tank 122 may also be referred to as an intermediate high pressure gas tank as the pressure level of the gas contained therein is higher than the pressure level of the gas contained in the first intermediate tank 120. It should however be readily understood that the first 120 and/or second 122 intermediate tanks are additional components that may be incorporated if desired. Hence, it may not be necessary to include the first 120 and/or second 122 intermediate tanks to the internal combustion engine arrangement for the functioning of controlling the internal combustion engine in the various modes described below.

By means of the internal combustion arrangement 100 depicted in FIG. 2, operation thereof is normally executed according to the following. Air is provided into the compression cylinder 102 via the inlet valve 402 of the compression cylinder 102. By means of the reciprocating motion of the compression piston, the air is compressed in a two stroke fashion before being exhausted to the conduit 302 via the outlet valve 404. The compressed air is directed into the first intermediate tank 120 and thereafter directed into the combustion cylinder 106 via the inlet valve 406 of the combustion cylinder 106. During the four stroke operation of the combustion piston in the combustion cylinder 106, the compressed air is even further compressed and combustible fuel is injected into the combustion chamber of the combustion cylinder 106. The compressed combustion gas is, after combustion, directed into the conduit 304 via the outlet valve 408 of the combustion cylinder and further directed into the second intermediate tank 122. The compressed combustion gas is thereafter directed into the expansion cylinder 110 via the inlet valve 410 of the expansion cylinder 110. The compressed combustion gas is, during the reciprocating two stroke motion of the expansion cylinder expanded and directed out from the expansion cylinder 110 via the outlet valve 412. The compression piston, the combustion piston and the expansion piston are connected to the crankshaft (not shown) of the internal combustion engine arrangement 100. The compression piston, the combustion piston and the expansion piston may be directly connected to one and the same crankshaft or connected to the crank shaft via an intermediate crankshaft or the like, which in turn is/are connected to the crankshaft via e.g. gear wheels in meshed connection with each other.

Figure 3A:
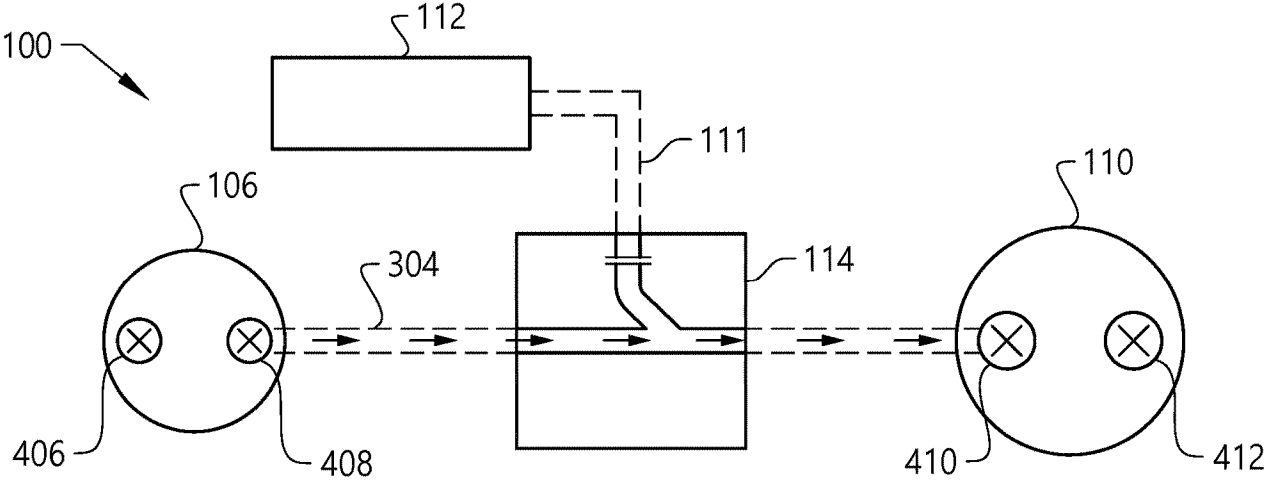
FIGS. 3*a*-3*c* schematically illustrate gas flow of the internal combustion arrangement for operating modes thereof according to an example embodiment.
Figure 3B:
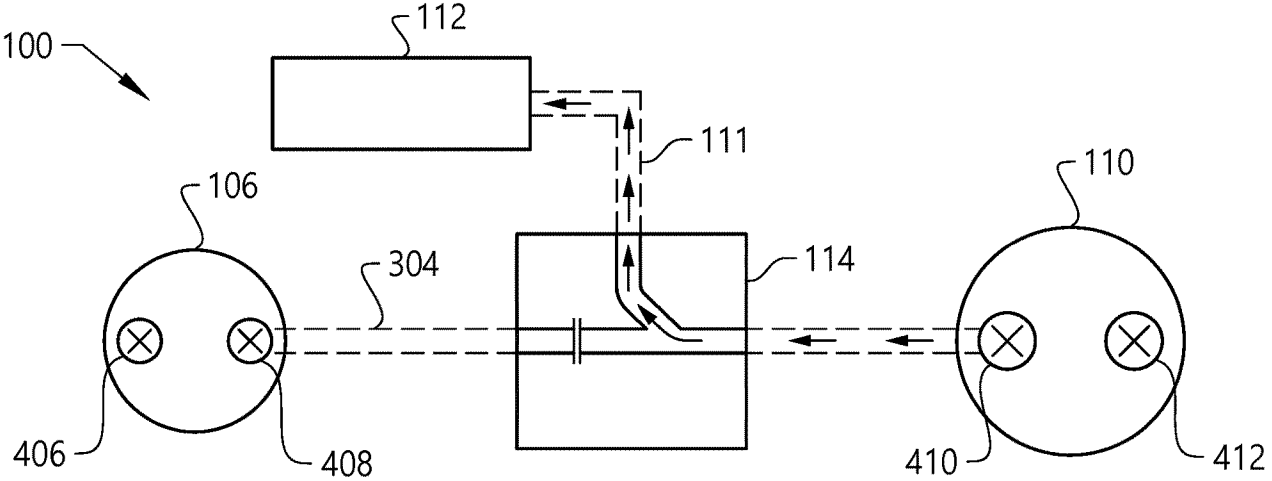
Figure 3C:
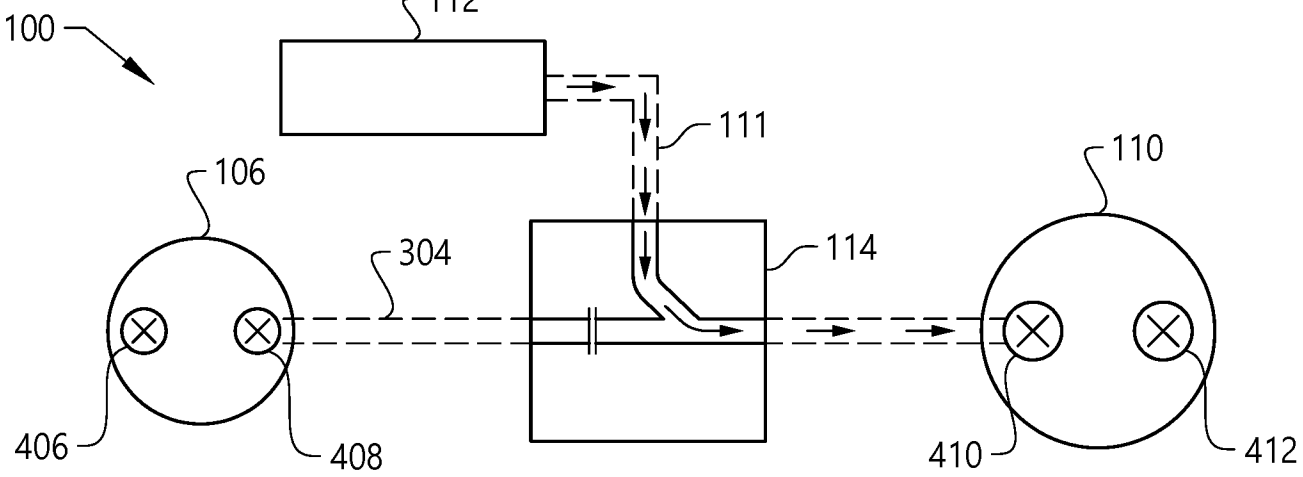

Reference is now made to FIGS. 3*a*-3*c* which illustrate three different operating modes for the internal combustion engine arrangement 100 according to example embodiments thereof. In detail, FIGS. 3*a*-3*c* schematically illustrate how the valve arrangement 114 is arranged to direct flow of gas for the various operating modes. In FIGS. 3*a*-3*b*, the compression cylinder 102, the first 120 and second 122 intermediate tanks, as well as the control unit 116 have been omitted for simplifying the illustration and understanding of the gas flow. Also, the valve arrangement 114 has been schematically depicted in each of FIGS. 3*a*-3*b* by focusing on the flow direction. The valve arrangement 114 may thus be designed in different forms as long as being controllable according to the below description.

Firstly, reference is made to FIG. 3*a* which illustrate the above described normal operation of the internal combustion arrangement 100. As can be seen in FIG. 3*a*, the valve arrangement 114 is arranged in a normal operating position where compressed gas is delivered from the outlet valve 408 of the combustion cylinder 106 and directed into the expansion cylinder 110 via the conduit 304 and the inlet valve 410 of the expansion cylinder 110. As can also be seen in FIG. 3*a*, the valve arrangement 114 is preventing compressed gas to be delivered to the pressure tank 112.

The internal combustion engine arrangement 100 is however also arranged to assume a first operating mode and a second operating mode. Reference is therefore made to FIG. 3*b* which illustrates the flow of compressed gas in the first operating mode. The internal combustion engine arrangement 100 is preferably arranged to be operated in the first operating mode when the vehicle is exposed to engine braking. The main target of the first operating mode is to provide compressed gas generated in the expansion cylinder 110 into the pressure tank 112. As can be seen in FIG. 3*b*, this is accomplished by positioning the valve arrangement in a first operating position allowing compressed gas to be delivered from the expansion cylinder 110 into the pressure tank 112. The expansion cylinder 110 receives gas in the form of ambient air, preferably through the outlet valve 412. The air/gas is compressed in the expansion cylinder 110 by means of the reciprocating motion of the expansion cylinder. The expansion cylinder 110 then acts as an air/gas pump for pumping the compressed gas from the expansion cylinder 110 into the pressure tank 112 via the pressure tank conduit 111. Hence, the valve arrangement 114 prevents flow of gas from the combustion cylinder 106 to the expansion cylinder 110, while allowing flow of compressed gas to be delivered from the expansion cylinder 110 and into the pressure tank 112.

When the pressure tank 112 comprises a sufficient amount of compressed gas, the internal combustion engine arrangement 100 can be arranged to assume the second operating mode. The second operating mode may also be referred to as an air hybrid mode. This is due to the fact that the internal combustion engine arrangement 100 will be operated by means of compressed gas from the pressure tank 112. The internal combustion engine arrangement 100 is preferably operated in the second operating mode when there is a desire to add additional power to the vehicle, such as for assisting an electric motor, etc. FIG. 3*c* illustrates the flow of compressed gas when the internal combustion engine arrangement 100 assumes the second operating mode. As can be seen, the valve arrangement 114 is positioned in the first operating position allowing compressed gas to be delivered from the pressure tank 112 to the expansion cylinder 110. Hereby, the compressed gas from the pressure tank 112 propels the internal combustion engine arrangement 100 by forcing the expansion piston to reciprocate within the expansion cylinder 110. As the expansion piston is connected to the crankshaft, propulsion of the internal combustion engine is achieved by forcing the expansion piston to reciprocate within the expansion cylinder 110. As is also depicted in FIG. 3*c*, the second operating position of the valve arrangement 114 prevents compressed gas from the combustion cylinder 106 to be delivered to the expansion cylinder 110. In the second operating mode, opening and closing timing of the inlet valve 410 of the expansion cylinder can be adjusted to allow more/less compressed gas therein. The first operating position of the valve arrangement 114 thus allows the flow of gas both to and from the pressure tank.

Figure 4:
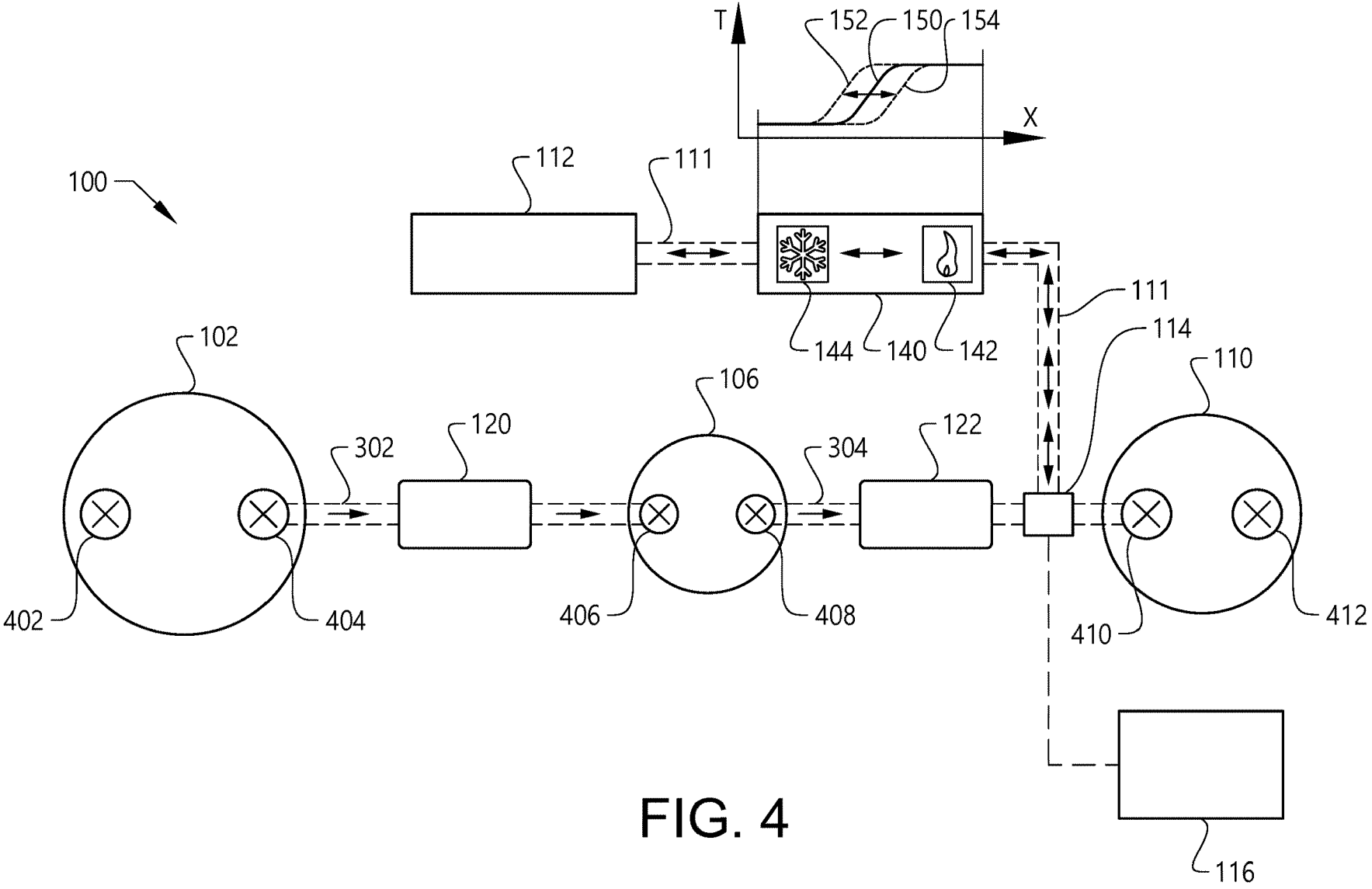
FIG. 4 is a schematic illustration of an internal combustion engine arrangement according to another example embodiment.

Reference is now made to FIG. 4 which illustrates another example embodiment of the internal combustion engine arrangement 100. The difference between the embodiment depicted in FIG. 2 and the embodiment depicted in FIG. 4 is that the embodiment in FIG. 4 comprises a heat regenerator 140. In more detail, the heat regenerator 140 is arranged in the pressure tank conduit 111 in fluid communication between the valve arrangement 114 and the pressure tank 112. The valve arrangement 114 is in FIG. 4 arranged to assume the different positions as described above in relation to the description of FIGS. 3*a*-3*c*. The flow direction in FIG. 4 is therefore illustrated by means of double sided arrows. Thus, flow is directed from the valve arrangement 114 to the pressure tank 112, via the heat regenerator 140, as depicted in FIG. 3*b* when the internal combustion engine arrangement 100 assumes the first operating mode, and the flow is directed from the pressure tank 112, via the heat regenerator 140, to the valve arrangement 114 when the internal combustion engine arrangement 100 assumes the second operating mode as depicted in FIG. 3*c*.

The heat regenerator 140 comprises a warm side 142 illustrated by a flame, and a cold side 144 illustrated by a snow flake. During operation, and when the internal combustion engine arrangement 100 assumes the first operating mode, relatively warm compressed gas is directed from the combustion cylinder 106 to the pressure tank 112 via the heat regenerator 140. The heat regenerator 140 absorbs the heat in the compressed combustion gas such that the compressed gas delivered to the pressure tank 112 is substantially at ambient temperature. The heat regenerator 140 thus absorbs the heat and "keeps" the heat until the internal combustion engine 100 assumes the second operating mode. In the second operating mode, the compressed gas in the pressure tank 112 is directed towards the valve unit 114 as depicted in FIG. 3*c*. When the compressed gas passes the heat regenerator 140, i.e. the gas travels along the heat regenerator 140, the thermal energy is released and transported with the compressed gas flow towards the expansion cylinder 110. By means of the heat regenerator 140, a substantially reversible process is achieved. The compressed gas leaving the heat regenerator 140 in the second operating mode will have substantially the same temperature as the temperature of the compressed gas that entered the heat regenerator in the first operating mode.

When the warm compressed gas from the combustion cylinder 106 is delivered towards the pressure tank 112, a majority of the heat will be absorbed at the warm side 142 of the heat regenerator 140. The heat in the heat regenerator 140 will be progressively reduced on its travel towards the cold side. Hereby, substantially all heat is removed when the compressed gas leaves the heat regenerator 140 and enters the pressure tank 112. As depicted in connection with the heat regenerator 140, a heat wave 150 is generated in the heat regenerator 140. When compressed gas is delivered from the expansion cylinder 110 to the pressure tank 112, the heat wave is moved towards the pressure tank 112 as indicated by the dotted wave with numeral 152. When compressed gas is delivered from the pressure tank 112 to the expansion cylinder 110, the heat wave is moved away from the pressure tank 112 as indicated by the dotted wave with numeral 154. There is thus a heat gradient in the heat regenerator 140, whereby a heat wave is formed when directing compressed gas to and from the pressure tank 112, which is caused by the relatively high energy utilization of the internal combustion engine arrangement 100. Preferably, the heat regenerator should have a relatively steep heat wave, i.e. a relatively steep heat gradient, whereby the temperature of the compressed gas is reduced relatively quickly when entering the heat regenerator 140. This will prevent the heat from leaking from the heat regenerator 140. Also, the thermal conductivity of the heat regenerator 140 should preferably be relatively low in the flow direction of the compressed gas. Also, the heat regenerator 140 should preferably be provided with suitable heat insulation (not shown).

Figure 5:
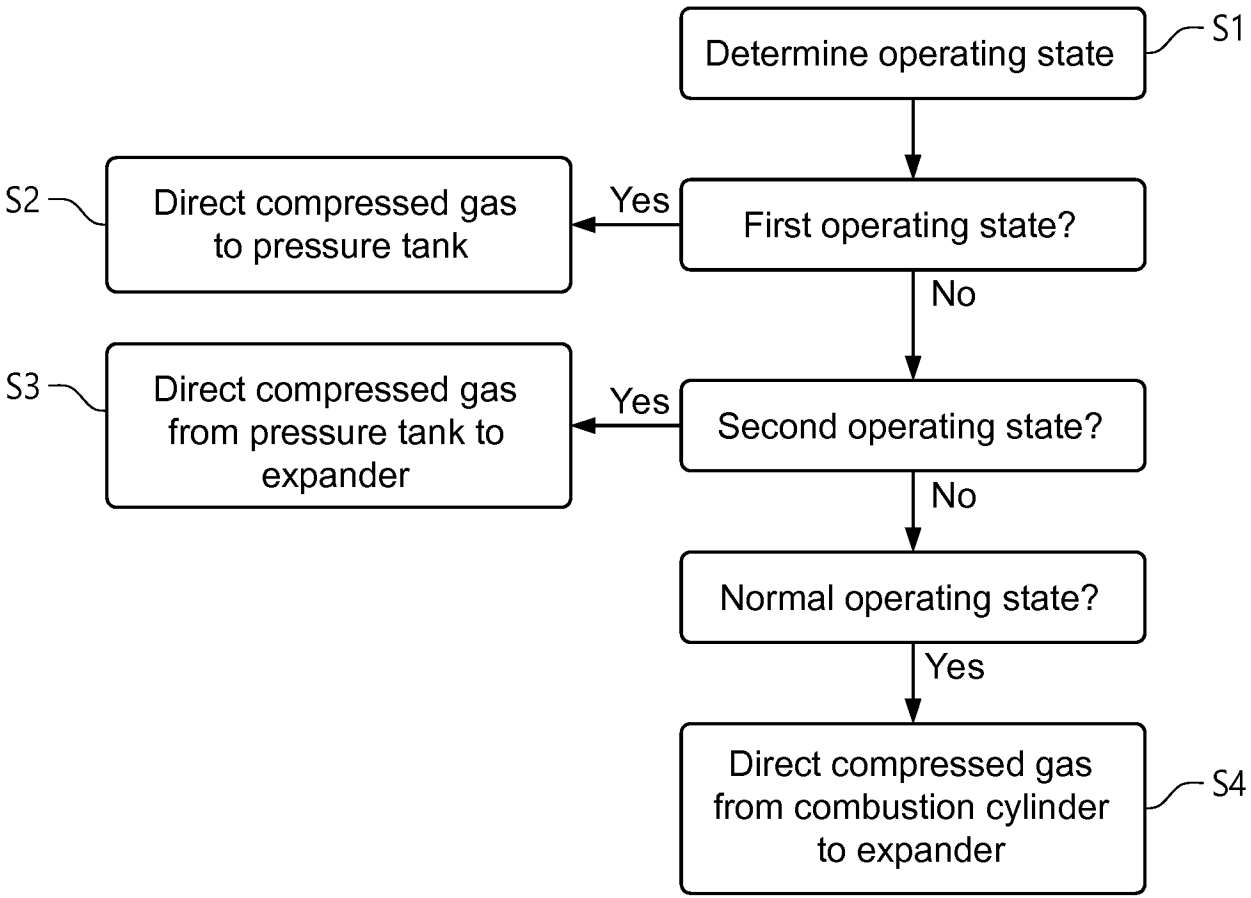
FIG. 5 is a flow chart illustrating a method for controlling an internal combustion engine arrangement according to an example embodiment.

In order to sum up and to describe a method for controlling the above described internal combustion engine arrangement 100 according to an example embodiment, reference is made to FIG. 5 in combination with FIGS. 2-4. When operating the internal combustion engine arrangement 100, such as e.g. in the above described normal operating mode which is depicted in FIG. 3*a*, an operating state of the vehicle 1 is determined S1. It is thereafter determined if the vehicle is operated in the first operating state or the second operating state. The first operating state preferably corresponds to an engine braking operation of the vehicle, while the second operating state preferably corresponds to a driving state where the vehicle is in need of an increased engine power for a shorter period of time. If it is determined that the vehicle is operated in the first operating state, compressed gas generated in the expansion cylinder 110 is controlled S2 to be directed to the pressure tank 112. Preferably, the compressed gas is directed to the pressure tank 112 via the above described heat regenerator 140 such that heat in the compressed gas is absorbed in the heat regenerator 140 before delivery to the pressure tank 112.

On the other hand, if it is determined that the vehicle is operated in the second operating state, the compressed gas contained in the pressure tank 112 is controlled S3 to be delivered from the pressure tank 112 to the expansion cylinder 110. Preferably, the compressed gas is directed to the expansion cylinder 110 via the heat regenerator 140 for heating the compressed gas before delivery to the expansion cylinder 110.

However, if it is determined that the vehicle is also not operated in the second operating state, and instead operated in a normal operating state, the internal combustion engine arrangement 100 may be controlled S4 to direct compressed gas from the combustion cylinder to the expansion cylinder as depicted and described above in relation to FIG. 3*a*.

Although the above has described the internal combustion engine arrangement 100 comprising a single compression cylinder 102, a single combustion cylinder 106 and a single expansion cylinder 110, it should be readily understood that other compression-combustion-expansion arrangements are conceivable. For example, two compression cylinders, two combustion cylinders and two expansion cylinders may also equally as well be used. Another alternative is to use a single compression cylinder, a single expansion cylinder and two combustion cylinders. A still further alternative is to use dual compression cylinders, dual combustion cylinders, dual expansion cylinders, wherein an additional compression cylinder is arranged in fluid communication between the dual compression cylinders and the dual combustion cylinders. Furthermore, instead of using a valve as depicted in e.g. FIGS. 3*a*-3*b*, the flow of gas to/from the pressure tank can be controlled by controlling the outlet valves of the combustion cylinders. Hereby, the outlet valves of the combustion cylinders can be kept close while delivering compressed gas to/from the pressure tank.

It is to be understood that the present invention is not limited to the embodiments described above and illustrated in the drawings; rather, the skilled person will recognize that many changes and modifications may be made within the scope of the appended claims.

The invention claimed is:

1. An internal combustion engine arrangement for a vehicle, the internal combustion engine arrangement comprising a combustion cylinder housing a reciprocating combustion piston, and an expansion cylinder housing a reciprocating expansion piston, the expansion cylinder being arranged in downstream fluid communication with the combustion cylinder for receiving combustion gases exhausted from the combustion cylinder, wherein the internal combustion engine arrangement further comprises a pressure tank arranged in fluid communication with the expansion cylinder, wherein the internal combustion engine arrangement is further arranged to be operated in a first operating mode in which compressed gas generated in the expansion cylinder is delivered to the pressure tank, and a second operating mode in which compressed gas contained in the pressure tank is delivered from the pressure tank to the expansion cylinder, wherein the internal combustion engine arrangement further comprises a heat regenerator arranged in fluid communication between the expansion cylinder and the pressure tank, the heat regenerator being arranged to absorb heat from the compressed gas generated by the expansion cylinder delivered to the pressure tank, and to release the heat when the compressed gas is transported from the pressure tank to the expansion cylinder.

2. The internal combustion engine arrangement according to claim 1, wherein the expansion cylinder is arranged to compress ambient air and to pump compressed ambient air to the pressure tank when the internal combustion engine arrangement is operated in the first operating mode.

3. The internal combustion engine arrangement according to claim 1, wherein combustion gas from the combustion cylinder is prevented from being directed to the expansion cylinder when the internal combustion engine arrangement is operated in the second operating mode.

4. The internal combustion engine arrangement according to claim 1, further comprising a control unit for selectively controlling the internal combustion engine to be operated in either one of the first and second operating modes.

5. The internal combustion engine arrangement according to claim 4, wherein the control unit is configured to: receive a signal indicative of a braking operation for the vehicle; and control the internal combustion engine arrangement to be operated in the first operating mode when the vehicle is exposed to the braking operation.

6. The internal combustion engine arrangement according to claim 4, wherein the control unit is further configured to: receive a signal indicative of a power level required for the vehicle, compare the required power level with a predetermined threshold limit; and control the internal combustion engine arrangement to be operated in the second operating mode when the required power level exceeds the predetermined threshold limit.

7. The internal combustion engine arrangement according to claim 1, further comprising a valve arrangement positioned in fluid communication with the combustion cylinder, the expansion cylinder and the pressure tank.

8. The internal combustion engine arrangement according to claim 7, further comprising an intermediate tank positioned in fluid communication between the combustion cylinder and the expansion cylinder, the intermediate tank being arranged to contain compressed gas exhausted from the combustion cylinder.

9. The internal combustion engine arrangement according to claim 8, wherein the valve arrangement is arranged downstream the intermediate tank.

10. The internal combustion engine arrangement according to claim 1, wherein the expansion cylinder comprises a geometric compression ratio of at least 40, the compression ratio being a ratio between a maximum and a minimum volume formed by the reciprocating motion of the expansion piston within the expansion cylinder.

11. The internal combustion engine arrangement according to claim 1, further comprising a compression cylinder housing a reciprocating piston, the compression cylinder being arranged in upstream fluid communication with the combustion cylinder for delivery of compressed air to the combustion cylinder.

12. A method for controlling an internal combustion engine arrangement, the internal combustion engine arrangement comprising a combustion cylinder housing a reciprocating combustion piston, an expansion cylinder housing a reciprocating expansion piston, the expansion cylinder being arranged in downstream fluid communication with the combustion cylinder for receiving combustion gases exhausted from the combustion cylinder, a pressure tank arranged in fluid communication with the expansion cylinder, and a heat regenerator arranged in fluid communication between the expansion cylinder and the pressure tank, wherein the method comprises the steps of:

determining an operating state of the vehicle;

when the vehicle is operated in a first operating state:

controlling compressed gas generated in the expansion cylinder to be directed to the pressure tank via the heat regenerator, wherein the heat regenerator absorbs heat from the compressed gas generated by the expansion cylinder delivered to the pressure tank; and when the vehicle is operated in a second operating state:

controlling compressed gas contained in the pressure tank to be delivered to the expansion cylinder via the heat regenerator, wherein the heat regenerator releases the heat to the compressed gas when the compressed gas is transported from the pressure tank to the expansion cylinder.

13. A computer program comprising program code means for performing the steps of claim 12 when the program is run on a computer.

14. A computer readable medium carrying a computer program comprising program means for performing the steps of claim 12 when the program means is run on a computer.

15. A vehicle comprising an internal combustion engine arrangement, the internal combustion engine arrangement comprising a combustion cylinder housing a reciprocating combustion piston, and an expansion cylinder housing a reciprocating expansion piston, the expansion cylinder being arranged in downstream fluid communication with the combustion cylinder for receiving combustion gases exhausted from the combustion cylinder, wherein the internal combustion engine arrangement further comprises a pressure tank arranged in fluid communication with the expansion cylinder, wherein the internal combustion engine arrangement is further arranged to be operated in a first operating mode in which compressed gas generated in the expansion cylinder is delivered to the pressure tank, and a second operating mode in which compressed gas contained in the pressure tank is delivered from the pressure tank to the expansion cylinder, wherein the vehicle further comprises a second prime mover different from the internal combustion engine arrangement, wherein the vehicle is configured to be operated in:

a first vehicle state in which the vehicle is propelled by providing compressed gas from the pressure tank to the expansion cylinder; and a second vehicle state in which the vehicle is propelled by using the second prime mover.

16. The vehicle according to claim 15, wherein the vehicle is operated in the first vehicle state when a power requirement for the vehicle is higher in comparison to operation in the second vehicle state.

* * * * *